US009350099B2

(12) United States Patent
Wu et al.

(10) Patent No.: US 9,350,099 B2
(45) Date of Patent: May 24, 2016

(54) CONNECTOR HAVING A CONDUCTIVE CASING WITH AN INCLINED PLANE PARALLEL TO A SECTION OF A TERMINAL

(71) Applicant: Wistron NeWeb Corp., Hsinchu (TW)

(72) Inventors: Huei-Chi Wu, Hsinchu (TW); Cheng-Hsiung Lu, Hsinchu (TW)

(73) Assignee: Wistron NeWeb Corp., Hsinchu (TW)

( * ) Notice: Subject to any disclaimer, the term of this patent is extended or adjusted under 35 U.S.C. 154(b) by 0 days.

(21) Appl. No.: 14/814,523

(22) Filed: Jul. 31, 2015

(65) Prior Publication Data

US 2016/0079693 A1 Mar. 17, 2016

(30) Foreign Application Priority Data

Sep. 16, 2014 (TW) ..... 103131893 A

(51) Int. Cl.
*H01R 12/00* (2006.01)
*H01R 12/72* (2011.01)
*H01R 12/59* (2011.01)

(52) U.S. Cl.
CPC ..... *H01R 12/721* (2013.01); *H01R 9/091* (2013.01); *H01R 12/59* (2013.01)

(58) Field of Classification Search
CPC ..... H01R 9/091; H01R 12/00; H01R 12/57; H01R 23/725; H01R 23/7073
USPC ..... 439/78–81, 92
See application file for complete search history.

(56) References Cited

U.S. PATENT DOCUMENTS 4,993,875 A * 2/1991 Nicholson, Sr. ..... F16L 58/00 285/294.4
5,352,125 A * 10/1994 Banakis ..... H01R 4/028 439/78
6,155,856 A * 12/2000 Sanada ..... H01R 9/091 439/246
6,302,708 B1 * 10/2001 Okabe ..... H01R 12/716 439/78
6,579,107 B1 * 6/2003 Sanroma ..... H01R 12/718 439/59
2008/0207018 A1 * 8/2008 Chiang ..... H05K 3/32 439/78
2011/0159712 A1 * 6/2011 Chang ..... H01R 12/55 439/78

* cited by examiner

*Primary Examiner* — Chandrika Prasad
(74) *Attorney, Agent, or Firm* — Jianq Chyun IP Office

(57) ABSTRACT

A connector including a conductive casing, a terminal, a first insulation structure and a conductive structure is provided. The conductive casing has an inner wall. The terminal includes a first section and a second section. The first section is disposed in the conductive casing, and the first section and the inner wall have a gap therebetween. The second section is located outside the conductive casing. The first insulation structure is disposed between the first section and the inner wall. The conductive structure is electrically connected to the conductive casing and has an inclined plane. The inclined plane is aligned to the second section, the second section and the inclined plane have a gap therebetween, and the inclined plane is parallel to a extending direction of the second section. In addition, a printed circuit board module having the connector is also provided.

15 Claims, 2 Drawing Sheets

CONNECTOR HAVING A CONDUCTIVE CASING WITH AN INCLINED PLANE PARALLEL TO A SECTION OF A TERMINAL

CROSS-REFERENCE TO RELATED APPLICATION

This application claims the priority benefit of Taiwan application serial no. 103131893, filed on Sep. 16, 2014. The entirety of the above-mentioned patent application is hereby incorporated by reference herein and made a part of this specification.

BACKGROUND

1. Technical Field

The invention relates to a connector and a printed circuit board module having the same, and particularly relates to a coaxial connector and a printed circuit board module having the same.

2. Related Art

Along with quick development of communication technology, various communication products are widely used, and a coaxial connector is one of indispensable parts of an electronic device such as a communication product, etc.

Generally, the coaxial connector includes a conductive casing disposed on a printed circuit board of the electronic device and a terminal located in the conductive casing, the terminal extends to the outside of the conductive casing to connect the printed circuit board. The terminal in the conductive casing and the printed circuit board has a height difference, so a part of a section of the terminal has to be extended in an inclined manner to connect to the printed circuit board. Therefore, the variation of the distance between such part of the terminal and a ground layer of the printed circuit board is large. Consequently, the impedance matching along the path of signal transmission is poor at such part, thereby significantly decreasing the signal transmission quality.

SUMMARY

The invention is directed to a connector, and a signal transmission path between the connector and a printed circuit board has a better impedance matching.

The invention is directed to a printed circuit board module, in which a signal transmission path between a connector and a printed circuit board has a better impedance matching.

The invention provides a connector including a conductive casing, a terminal, a first insulation structure and a conductive structure. The conductive casing has an inner wall. The terminal has a first section and a second section. The first section is disposed in the conductive casing, and the first section and the inner wall have a gap therebetween. The second section is located outside the conductive casing. The first insulation structure is disposed between the first section and the inner wall. The conductive structure is electrically connected to the conductive casing and has an inclined plane. The second section and the inclined plane have a gap therebetween, and the inclined plane is parallel to an extending direction of the second section.

The invention provides a printed circuit board module including a printed circuit board and a connector. The printed circuit board has a circuit layer and a ground layer. The connector includes a conductive casing, a terminal, a first insulation structure and a conductive structure. The conductive casing is disposed on the printed circuit board and has an inner wall. The ground layer is electrically connected to the conductive casing. The terminal includes a first section and a second section. The first section is disposed in the conductive casing, and the first section and the inner wall have a gap therebetween. The second section is located outside the conductive casing and is electrically connected to the circuit layer. The first insulation structure is disposed between the first section and the inner wall. The conductive structure is disposed between the second section and the printed circuit board and is electrically connected to the conductive casing. The conductive structure has an inclined plane. The second section and the inclined plane have a gap therebetween, and the inclined plane is parallel to an extending direction of the second section.

In an embodiment of the invention, the extending direction of the second section is inclined to an extending direction of the first section.

In an embodiment of the invention, the extending direction of the second section is inclined to an extending direction of the printed circuit board.

In an embodiment of the invention, the conductive casing has a side surface, the side surface has an opening, the terminal extends to the outside of the conductive casing through the opening, and the conductive structure is connected to the side surface.

In an embodiment of the invention, the conductive structure is integrally connected with the conductive casing.

In an embodiment of the invention, the connector further includes a second insulation structure, where the second insulation structure is disposed between the second section and the inclined plane.

In an embodiment of the invention, the second insulation structure is integrally connected with the first insulation structure.

In an embodiment of the invention, the circuit board has a pad, the ground layer is connected to the pad, and the conductive casing contacts the pad.

In an embodiment of the invention, the conductive structure is disposed between the second section and the pad.

In an embodiment of the invention, the conductive structure contacts the pad.

According to the above descriptions, in the printed circuit board module and the connector of the invention, the conductive structure is electrically connected to the conductive casing and the ground layer of the printed circuit board, such that the conductive structure, the conductive casing and the ground layer of the printed circuit board commonly construct a ground structure of the printed circuit board module. The conductive structure is located between the second section of the terminal and the printed circuit board, such that the inclined plane of the conductive structure becomes a ground surface aligned to the second section of the terminal. Since the inclined plane and the second section are parallel to each other, a variation amount of a distance between the second section of the terminal and the ground structure is decreased, such that the signal transmission path has a good impedance matching at such section, so as to improve the signal transmission quality.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
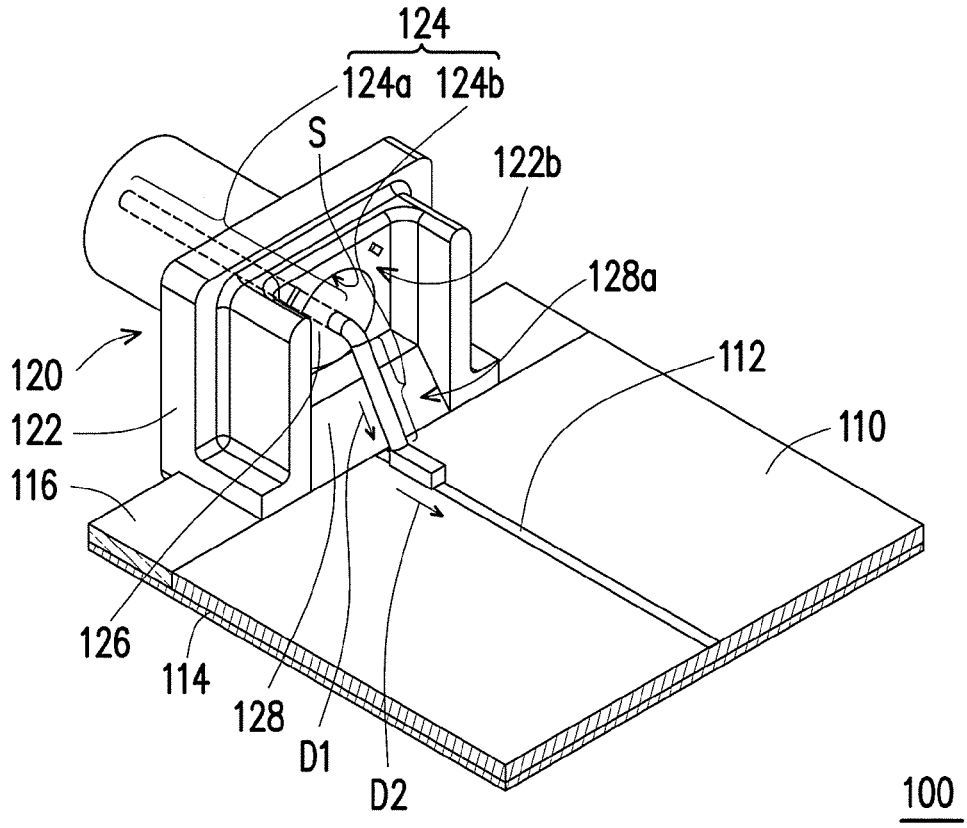
FIG. 1 is a perspective view of a printed circuit board module according to an embodiment of the present invention.
Figure 2:
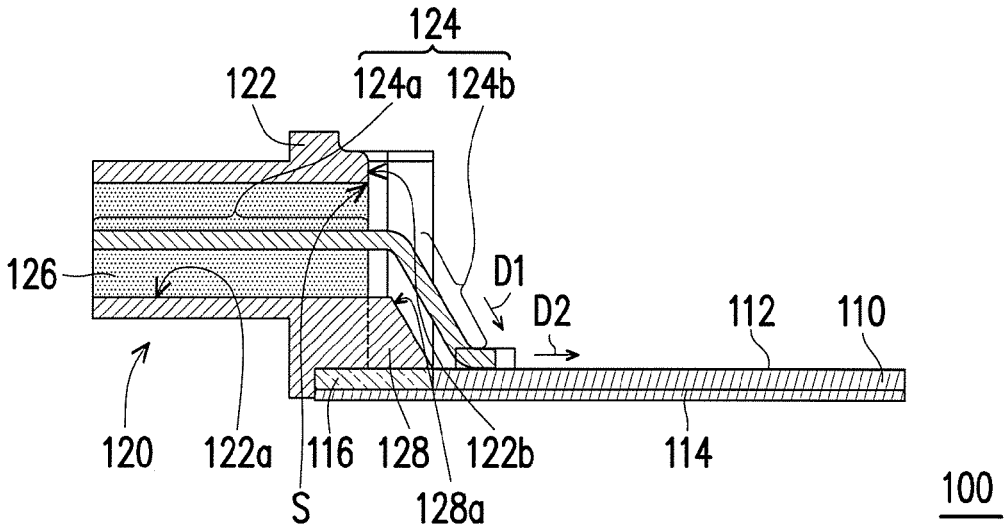
FIG. 2 is a cross-sectional view of the printed circuit board module of FIG. 1.

FIG. 1 is a perspective view of a printed circuit board module according to an embodiment of the present invention. FIG. 2 is a cross-sectional view of the printed circuit board module of FIG. 1. Referring to FIG. 1 and FIG. 2, the printed circuit board module 100 of the present embodiment includes a printed circuit board 110 and a connector 120. The printed circuit board 110 is, for example, a motherboard of an electronic device. The connector 120 is disposed on the printed circuit board 110. The connector is, for example, an F connector or other types of coaxial connector adapted to be connected to an external cable joint in order to transmit signal to the electronic device.

In detail, the printed circuit board 110 has a circuit layer 112, a ground layer 114 and a pad 116. The connector 120 includes a conductive casing 122, a terminal 124, a first insulation structure 126, and a conductive structure 128. The conductive casing 122 is disposed on the printed circuit board 110 and has an inner wall 122*a*. The ground layer 114 of the printed circuit board 110 is electrically connected to the pad 116, and the conductive casing 122 contacts the pad 116 for electrically connecting to the ground layer 114 though the pad 116. The terminal 124 includes a first section 124*a* and a second section 124*b*. The first section 124*a* of the terminal 124 is disposed in the conductive casing 122, and the first section 124*a* and the inner wall 122*a* of the conductive casing 122 have a gap therebetween. The first insulation structure 126 is disposed between the first section 124*a* of the terminal 124 and the inner wall 122*a* of the conductive casing 122 for positioning the first section 124*a* and for avoiding electrically connection between the first section 124*a* and the conductive casing 122.

The conductive casing 122 has a side surface 122*b*, and the side surface 122*b* has an opening S. The terminal 124 extends to the outside of the conductive casing 122 through the opening S on the side surface 122*b* of the conductive casing 122, such that the second section 124*b* of the terminal 124 is located outside the conductive casing 122. An extending direction Dl of the second section 124*b* is inclined to an extending direction D2 of the first section 124*a*, and the second section 124*b* is extended to the circuit layer 112 of the printed circuit board 110 and is also electrically connected to the circuit layer 112, and that the printed circuit board 110 can transmit signals through the terminal 124 of the connector 120.

The conductive structure 128 is connected to the side surface 122*b* of the conductive casing 122 for electrically connecting to the conductive casing 122. The conductive structure 128 contacts the pad 116 for electrically connecting to the ground layer 114 of the printed circuit board 110 through the pad 116. The conductive structure 128 has an inclined plane 128*a* located between the second section 124*b* of the terminal 124 and the pad 116. Additionally, a gap may exist between the second section 124*b* and the inclined plane 128*a*, and the inclined plane 128*a* is parallel to the extending direction D1 of the second section 124*b*.

Under the above configuration, the conductive structure 128 is electrically connected to the conductive casing 122, the pad 116 and the ground layer 114, such that the conductive structure 128, the conductive casing 122, the pad 116 and the ground layer 114 commonly constitute a ground structure of the printed circuit board module 100. The conductive structure 128 is located between the second section 124*b* of the terminal 124 and the printed circuit board 110, and the inclined plane 128*a* and the second section 124*b* are parallel to each other. Therefore, the variation of the distance between the second section 124*b* of the terminal 124 and the ground structure is reduced. As a result, the signal transmission path may obtain a better impedance matching at such section, so as to significantly improve the signal transmission quality.

In the present embodiment, the material of the first insulation structure 126 is, for example, plastic. Moreover, the material of the conductive casing 122 and the conductive structure 128 can be, for example, metal. The conductive structure 128 can be integrally connected with the side surface 122*b* of the conductive casing 122 to simplify the fabrication process of the connector 100. Nonetheless, the present invention should not be limited to the above. In other embodiments, the conductive structure 128 and the conductive casing 122 can be non-integrally formed structures.

Figure 3:
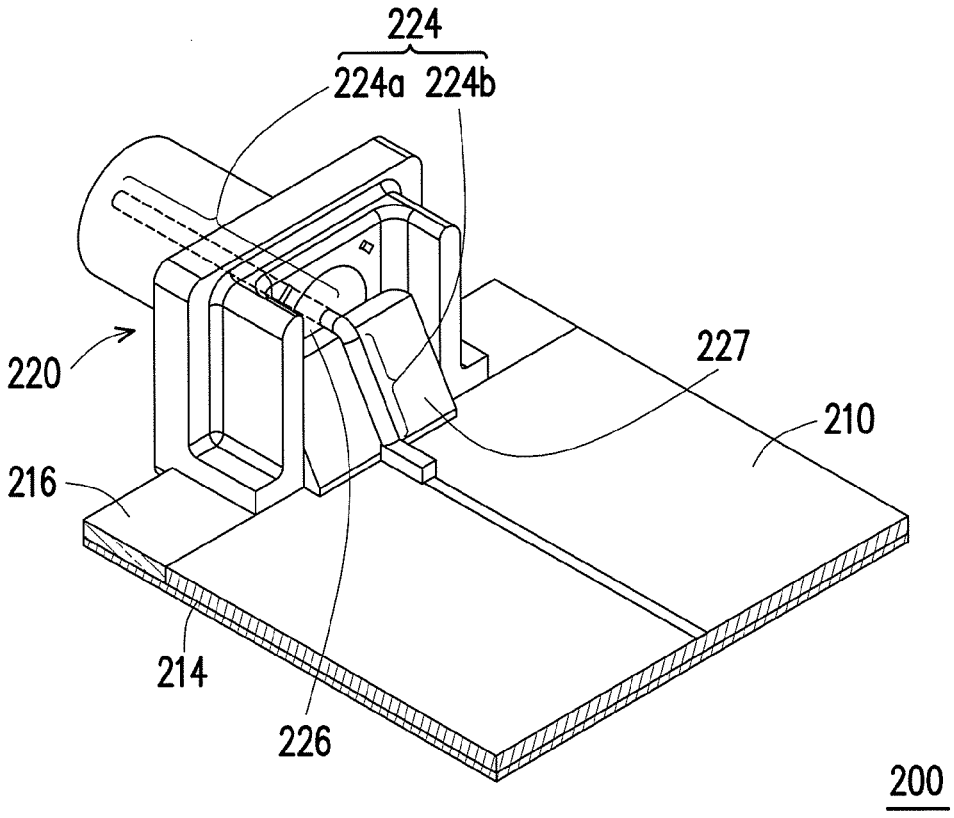
FIG. 3 is a perspective view of a printed circuit board module according to another embodiment of the present invention.
Figure 4:
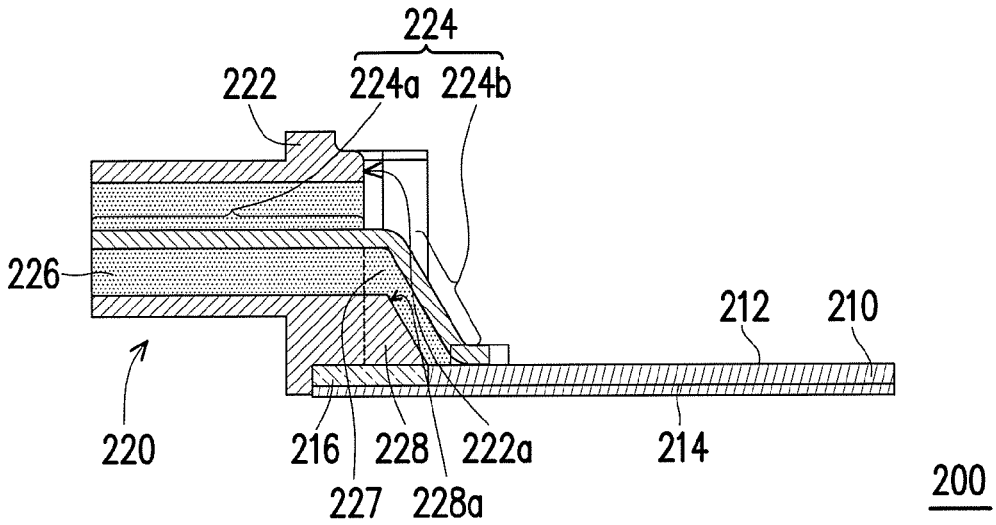
FIG. 4 is a cross-sectional view of the printed circuit board module of FIG. 3.

FIG. 3 is a perspective view of a printed circuit board module according to another embodiment of the present invention. FIG. 4 is a cross-sectional view of the printed circuit board module of FIG. 3. In the printed circuit board module 200 of FIG. 3 and FIG. 4, the configurations and functions of a printed circuit board 210, a circuit layer 212, a ground layer 214, a pad 216, a conductive casing 222, a terminal 224, a first section 224*a*, a second section 224*b*, a first insulation structure 226 and a conductive structure 228 are same to the configurations and functions of the corresponding printed circuit board 110, the circuit layer 112, the ground layer 114, the pad 116, the conductive casing 122, the terminal 124, the first section 124*a*, the second section 124*b*, the first insulation structure 126, and the conductive structure 128 set forth above and in FIG. 1 and FIG. 2. The redundant details will not be repeated again in the following. The main difference between the printed circuit board module 200 and the printed circuit board module 100 is that the connector 200 further includes a second insulation structure 227. The second insulation structure 227 is disposed between the second section 224*b* of the terminal 224 and an inclined plane 228*a* of the conductive structure 228, so as to strengthen the structure of the connector 220 by providing more support to the second section 224*b* by the second insulation structure 227.

In the present embodiment, the material of the first insulation structure 226 and the second insulation structure 227 can be, for example, plastic, and the second insulation structure 227 can be integrally connected with the first insulation structure 226 to simplify the fabrication process of the connector 200. Nonetheless, the invention should not be limited to the above, the first insulation structure 226 and the second insulation structure 227 can also be non-integrally formed structures.

In summary, as in the printed circuit board module and the connector of the present invention, the conductive structure is electrically connected to the conductive casing, the pad, and the ground layer, thus the conductive structure, the conductive casing, the pad, and the ground layer commonly constitute a ground structure of the printed circuit board module. Since the conductive structure is located between the second section of the terminal and the printed circuit board, the inclined plane of the conductive structure becomes to be a ground surface corresponding to the second section of the terminal. Since the inclined plane and the second section are parallel to each other, the variation of the distance between the second section of the terminal and the ground structure is reduced, thereby providing a better impedance matching for signal transmission especially at such section, so as to significantly improve the overall signal transmission quality. Moreover, the conductive structure and the conductive casing can be designed as integrally formed structures, and the first insulation structure in the conductive casing and the second insulation structure outside the conductive casing can be designed as integrally formed structures as well, thereby simplifying the fabrication process of the connector.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A connector, comprising:

a conductive casing having an inner wall;

a terminal having a first section and a second section, wherein the first section is disposed in the conductive casing, the first section and the inner wall have a gap therebetween, and the second section is located outside the conductive casing;

a first insulation structure disposed between the first section and the inner wall; and a conductive structure electrically connected to the conductive casing and having an inclined plane, wherein the second section and the inclined plane have a gap therebetween, and the inclined plane is parallel to an extending direction of the second section.

2. The connector as claimed in claim 1, wherein the extending direction of the second section is inclined to an extending direction of the first section.

3. The connector as claimed in claim 1, wherein the conductive casing has a side surface, the side surface has an opening, the terminal extends to the outside of the conductive casing through the opening, and the conductive structure is connected to the side surface.

4. The connector as claimed in claim 1, wherein the conductive structure is integrally connected with the conductive casing.

5. The connector as claimed in claim 1, further comprising a second insulation structure, wherein the second insulation structure is disposed between the second section and the inclined plane.

6. The connector as claimed in claim 5, wherein the second insulation structure is integrally connected with the first insulation structure.

7. A printed circuit board module, comprising:

a printed circuit board having a circuit layer and a ground layer; and a connector comprising:

a conductive casing disposed on the printed circuit board and having an inner wall, wherein the ground layer is electrically connected to the conductive casing;

a terminal comprising a first section and a second section, wherein the first section is disposed in the conductive casing, the first section and the inner wall have a gap therebetween, and the second section is located outside the conductive casing and is electrically connected to the circuit layer;

a first insulation structure, disposed between the first section and the inner wall; and a conductive structure, disposed between the second section and the printed circuit board and electrically connected to the conductive casing, wherein he conductive structure has an inclined plane, the second section and the inclined plane have a gap therebetween, and the inclined plane is parallel to an extending direction of the second section.

8. The printed circuit board module as claimed in claim 7, wherein the extending direction of the second section is inclined to an extending direction of the printed circuit board.

9. The printed circuit board module as claimed in claim 7, wherein the conductive casing has a side surface, the side surface has an opening, the terminal extends to the outside of the conductive casing through the opening, and the conductive structure is connected to the side surface.

10. The printed circuit board module as claimed in claim 7, wherein the conductive structure is integrally connected with the conductive casing.

11. The printed circuit board module as claimed in claim 7, wherein the connector further comprises a second insulation structure, and the second insulation structure is disposed between the second section and the inclined plane.

12. The printed circuit board module as claimed in claim 11, wherein the second insulation structure is integrally connected with the first insulation structure.

13. The printed circuit board module as claimed in claim 7, wherein the printed circuit board has a pad, the ground layer is connected to the pad, and the conductive casing contacts the pad.

14. The printed circuit board module as claimed in claim 13, wherein the conductive structure is disposed between the second section and the pad.

15. The printed circuit board module as claimed in claim 13, wherein the conductive structure contacts the pad.

* * * * *